US011603998B2

(12) United States Patent
Umehara

(10) Patent No.: US 11,603,998 B2
(45) Date of Patent: Mar. 14, 2023

(54) OUTDOOR UNIT AND AIR CONDITIONER

(71) Applicant: Mitsubishi Electric Corporation, Tokyo (JP)

(72) Inventor: Shigeo Umehara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 57 days.

(21) Appl. No.: 17/295,478

(22) PCT Filed: Jan. 30, 2019

(86) PCT No.: PCT/JP2019/003203
§ 371 (c)(1),
(2) Date: May 20, 2021

(87) PCT Pub. No.: WO2020/157871
PCT Pub. Date: Aug. 6, 2020

(65) Prior Publication Data
US 2022/0003434 A1 Jan. 6, 2022

(51) Int. Cl.
*F24F 1/24* (2011.01)

(52) U.S. Cl.
CPC ..... *F24F 1/24* (2013.01)

(58) Field of Classification Search
CPC ..... F24F 1/24
USPC ..... 62/426
See application file for complete search history.

(56) References Cited

U.S. PATENT DOCUMENTS

2010/0294466 A1* 11/2010 Shimaoka ..... F24F 1/54 165/104.33
2019/0226690 A1 7/2019 Torii et al.

FOREIGN PATENT DOCUMENTS

EP 2244024 A1 * 10/2010 ..... F24F 1/20
JP S59-168684 U 11/1984
JP 07091691 A 4/1995
JP H07-022324 U 4/1995
JP 2000164773 A * 6/2000
JP 2000164773 A 6/2000
(Continued)

OTHER PUBLICATIONS

Office Action dated Dec. 21, 2021 for the corresponding JP Patent Application No. 2020-569241 (and an English machine translation).
(Continued)

*Primary Examiner* — Steve S Tanenbaum
(74) *Attorney, Agent, or Firm* — Posz Law Group, PLC

(57) ABSTRACT

An outdoor unit includes a casing with an inlet in a back surface and an outlet in a front surface, a fan in the casing which draws air in the inlet and blows air out the outlet, a compressor in the casing, and a partition plate partitioning the interior into a machine room with the compressor and a blower room with the fan. A control board is installed horizontally on top of the partition plate across the machine room and the blower room, an electric component box covers the control board, a heat-generating component on the blower room side of the control board drives the compressor and the fan, and a cooler connects to the heat-generating component and includes fins exposed from the electric component box. A curved vertical separation surface is between the electronic component and the blower room, and between the electronic component and the back surface.

8 Claims, 6 Drawing Sheets

(56) References Cited

FOREIGN PATENT DOCUMENTS

| | | | | |
|---|---|---|---|---|
| JP | 2005-257126 | A | | 9/2005 |
| JP | 2008261508 | A | * | 10/2008 |
| JP | 2010190454 | A | | 9/2010 |
| JP | 2011-007363 | A | | 1/2011 |
| JP | 2011-149648 | A | | 8/2011 |
| WO | 2006/054547 | A1 | | 5/2006 |
| WO | 2013/005810 | A1 | | 1/2013 |
| WO | 2018/062170 | A1 | | 4/2018 |

OTHER PUBLICATIONS

Office Action dated Apr. 28, 2022 for the corresponding Chinese Patent Application No. 201980089973.8 (and English machine translation).
Office Action dated May 11, 2022 for the corresponding German Patent Application No. 112019006768.0 (and English translation).
International Search Report dated Apr. 9, 2019, issued in corresponding International Application No. PCT/JP2019/003203.
Office Action dated Mar. 28, 2022 for the corresponding Indian Patent Application No. 202127026409.
Office Action dated Apr. 19, 2022 for the corresponding Japanese Patent Application No. 2020-569241 and (English translation).
Office Action dated Sep. 15, 2022 for the corresponding Chinese Patent Application No. 201980089973.8 (and English machine translation).

* cited by examiner

OUTDOOR UNIT AND AIR CONDITIONER

CROSS REFERENCE TO RELATED APPLICATION

This application is a U.S. national stage application of International Patent Application No. PCT/JP2019/003203, filed on Jan. 30, 2019, the disclosure of which is incorporated herein by reference.

TECHNICAL FIELD

The present invention relates to an outdoor unit including a compressor, a fan, and a control board, and an air conditioner.

BACKGROUND

Conventional air conditioners include an outdoor unit that includes a compressor, a fan, a heat exchanger, and a control board. The interior of the casing of the outdoor unit is partitioned by a partition plate into a blower room in which the fan is installed and a machine room in which the compressor is installed. In the outdoor unit disclosed in Patent Literature 1, the control board is installed horizontally on the top of the partition plate. The control board is installed across the blower room and the machine room. In the machine room, the control board is accommodated in an electric component box. A power module is mounted on the control board. The electric component box is provided with a cooler that dissipates heat generated by the power module. The cooler is exposed in the blower room. The cooler has a plurality of fins. By the operation of the fan, air flowing in the blower room is passed through the surfaces of the plurality of fins to dissipate heat via the plurality of fins.

PATENT LITERATURE

Patent Literature 1: Japanese Patent Application Laid-open No. 2011-7363

However, in the outdoor unit described in Patent Literature 1, the flow of air in the blower room and the orientation of the fins of the cooler are not optimized, and heat generated by the power module may not be able to be sufficiently dissipated. This poses the problem that it is necessary to increase the size of the cooler, or to reduce the operating capacity of the air conditioner to reduce the generation of heat from the power module.

SUMMARY

The present invention has been made in view of the above, and an object thereof is to provide an outdoor unit that allows an improvement in the efficiency of heat dissipation from a cooler to prevent a reduction in the operating capacity of an air conditioner.

To solve the aforementioned problems and achieve the object, an outdoor unit according to the present invention includes a casing with an inlet formed in a back surface and an outlet formed in a front surface, a fan accommodated in the casing to draw in air from the inlet and blow out the air from the outlet, a compressor accommodated in the casing to compress a refrigerant, a heat exchanger accommodated in the casing to cause heat exchange between the refrigerant and the air, a partition plate partitioning an interior of the casing into a machine room in which the compressor is installed and a blower room in which the fan is installed, a control board installed horizontally on a top of the partition plate across the machine room and the blower room, an electric component box covering the control board, a heat-generating component installed on the blower room side of the control board to drive the compressor and the fan, and a cooler connected to the heat-generating component and including a plurality of fins exposed from the electric component box. The plurality of fins has main surfaces facing the front surface, and the lowest fin of the fins on the back surface side of a center of the cooler as viewed from the front surface is higher than the highest fin of the fins on the front surface side of the center of the cooler as viewed from the front surface.

The present invention achieves an effect of being able to provide an outdoor unit that allows an improvement in the efficiency of heat dissipation from a cooler to prevent a reduction in the operating capacity of an air conditioner.

DETAILED DESCRIPTION

Hereinafter, an outdoor unit and an air conditioner according to embodiments of the present invention will be described in detail with reference to the drawings. Note that the embodiments are not intended to limit this invention.

First Embodiment

Figure 1:
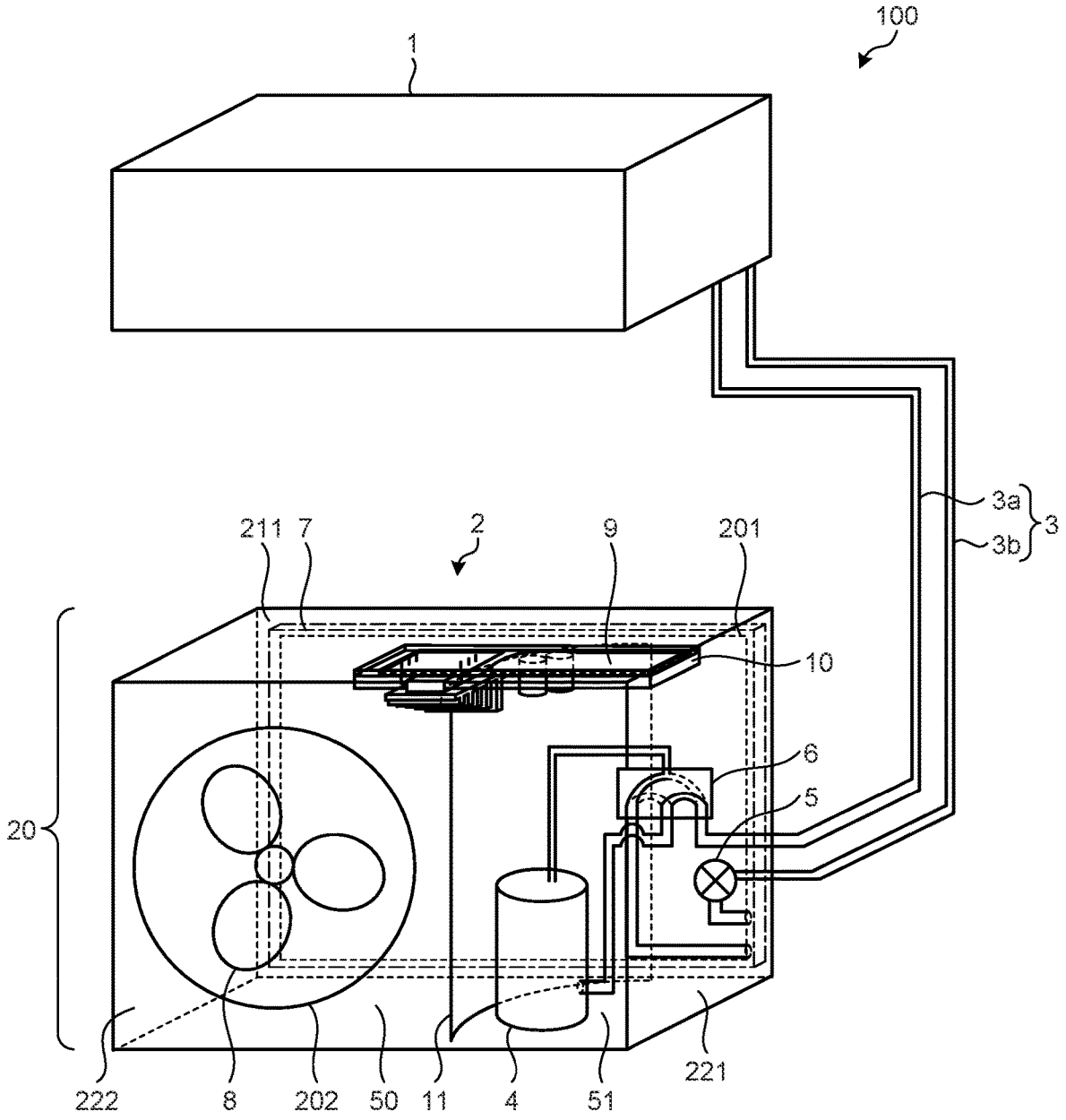
FIG. 1 is a diagram illustrating a configuration of an air conditioner according to a first embodiment.

FIG. 1 is a diagram illustrating a configuration of an air conditioner according to a first embodiment. An air conditioner 100 has an indoor unit 1 and an outdoor unit 2. The indoor unit 1 and the outdoor unit 2 are connected via a gas connecting pipe 3*a* and a liquid connecting pipe 3*b*. The gas connecting pipe 3*a* and the liquid connecting pipe 3*b* are also collectively referred to as refrigerant piping 3. The refrigerant piping 3 is filled with a refrigerant, which circulates between the indoor unit 1 and the outdoor unit 2 through the refrigerant piping 3, so that the air conditioner 100 exchanges heat between the inside and the outside of a room.

The outdoor unit 2 includes a casing 20, a compressor 4, an expansion valve 5, a four-way valve 6, a heat exchanger 7, a fan 8, a control board 9, an electric component box 10, and a partition plate 11. The casing 20 accommodates the compressor 4, the expansion valve 5, the four-way valve 6, the heat exchanger 7, the fan 8, the control board 9, the electric component box 10, and the partition plate 11 inside. The casing 20 has a back surface 211 in which an inlet 201 is formed, and a front surface 222 in which a bell mouth 202, which is an outlet, is formed. The refrigerant piping 3 is connected to the side surface 221 side of the casing 20.

The refrigerant circulates through the refrigerant piping 3, the compressor 4, the expansion valve 5, the four-way valve 6, the heat exchanger 7, and a heat exchanger included in the indoor unit 1, forming a refrigeration cycle. The heat exchanger 7 covers the back surface 211. The compressor 4 compresses the refrigerant. The heat exchanger 7 causes heat exchange between the refrigerant and air. The fan 8 rotates, drawing air in from the inlet 201 and blowing it out from the bell mouth 202. The air drawn in from the inlet 201 passes through the heat exchanger 7. When the air passes through the heat exchanger 7, heat exchange is performed between the air and the heat exchanger 7. The control board 9 includes a control unit that controls the compressor 4, the expansion valve 5, the four-way valve 6, and the fan 8. The partition plate 11 partitions the interior of the casing 20 into a blower room 50 in which the heat exchanger 7 and the fan 8 are installed, and a machine room 51 in which the compressor 4, the expansion valve 5, and the four-way valve 6 are installed. The control board 9 is horizontally fixed on the top of the partition plate 11 across the machine room 51 and the blower room 50. The electric component box 10 covers the control board 9.

Figure 2:
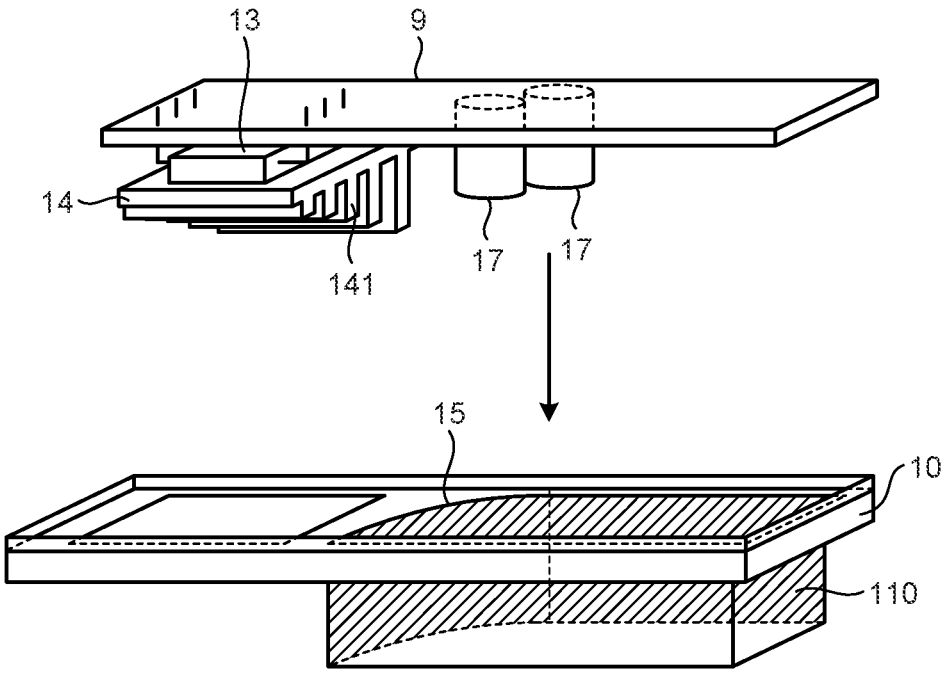
FIG. 2 is a diagram illustrating a configuration example of a control board and an electric component box according to the first embodiment.

FIG. 2 is a diagram illustrating a configuration example of the control board 9 and the electric component box 10 according to the first embodiment. A first power module 13 that drives the compressor 4 and the fan 8 and two electronic components 17 are mounted on the control board 9. In the present embodiment, the first power module 13 is mounted on the control board 9, but other than the first power module 13, a heat-generating component that generates heat may be mounted. The heat-generating component includes a first power module. The first power module 13 is mounted on the blower room 50 side of the control board 9, and is exposed from the electric component box 10. The electronic components 17 are electrolytic capacitors or the like. The electronic components 17 are mounted on the machine room 51 side of the control board 9 and are placed away from a cooler 14. The cooler 14 is connected to the first power module 13. The cooler 14 has a plurality of fins 141 to dissipate heat generated by the first power module 13. The cooler 14 is exposed from the electric component box 10. When the plurality of fins 141 is viewed from the front surface 222 of the outdoor unit 2, main surfaces of the fins 141 that are surfaces with large areas face the front surface 222. When viewed from the front surface 222 of the outdoor unit 2, the lowest fin of the fins 141 on the back surface 211 side of the center of the cooler 14 is higher than the highest fin of those on the front surface 222 side of the center of the cooler 14. The electronic components 17 are higher than the lowest fin 141 of the plurality of fins 141.

The electric component box 10 includes a housing chamber 110 in which the electronic components 17 are housed. Of the surfaces constituting the housing chamber 110, a separation surface 15 facing the machine room 51 side approaches the side surface 221 of the casing 20 on the machine room 51 side as it gets closer to the back surface 211. Like the separation surface 15, the partition plate 11 also approaches the side surface 221 of the casing 20 on the machine room 51 side as it gets closer to the back surface 211. The separation surface 15 is a portion indicated by oblique lines in FIG. 2.

Figure 3:
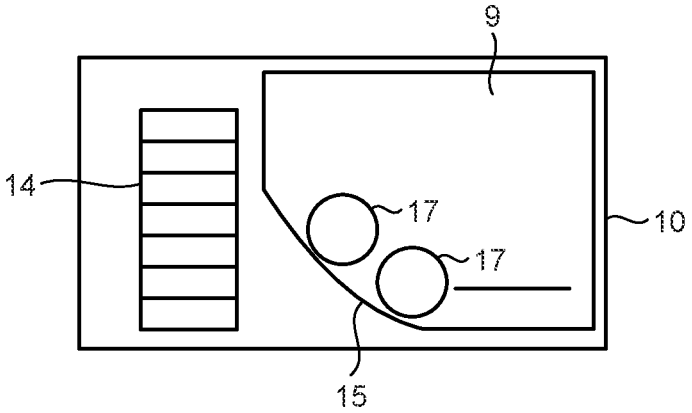
FIG. 3 is a bottom view of the control board and the electric component box according to the first embodiment as viewed from the underside of an outdoor unit.
Figure 4:
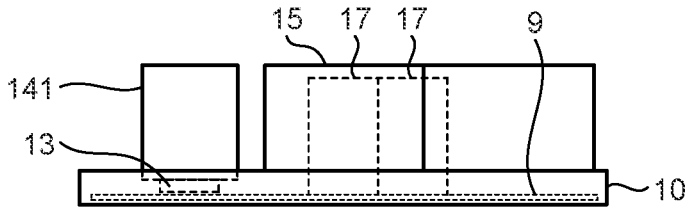
FIG. 4 is a front view of the control board and the electric component box according to the first embodiment.
Figure 5:
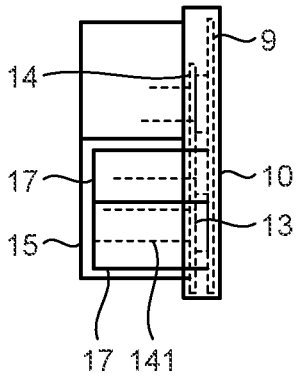
FIG. 5 is a right-side view of the control board and the electric component box according to the first embodiment.

FIG. 3 is a bottom view of the control board 9 and the electric component box 10 according to the first embodiment as viewed from the underside of the outdoor unit 2. FIG. 4 is a front view of the control board 9 and the electric component box 10 according to the first embodiment. FIG. 5 is a right-side view of the control board 9 and the electric component box 10 according to the first embodiment. As illustrated in FIGS. 3 to 5, the separation surface 15 constituting the electric component box 10 creates a space between the electric component box 10 and the cooler 14. The electronic components 17 included in the electric component box 10 cannot be installed in the space between the electric component box 10 and the cooler 14, and thus are installed away from the cooler 14. The separation surface 15 allows a current of air between the separation surface 15 and the cooler 14 to flow easily.

Figure 6:
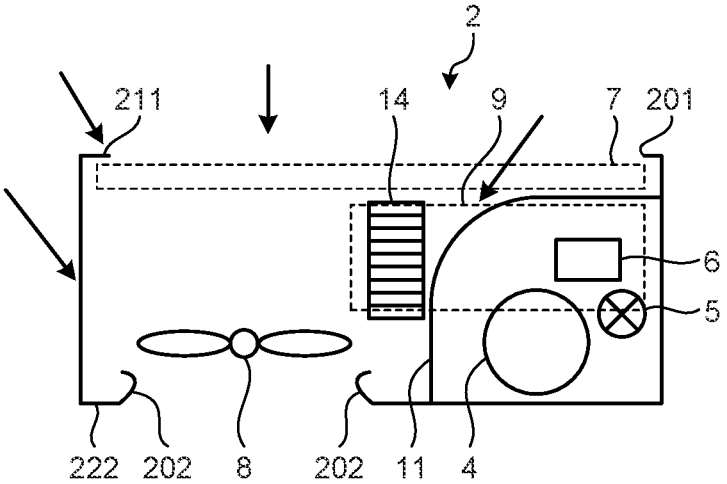
FIG. 6 is an opened-up view of the outdoor unit according to the first embodiment as viewed from above.

FIG. 6 is an opened-up view of the outdoor unit 2 according to the first embodiment as viewed from above. Currents of air traveling from the back surface 211 side to the front surface 222 side as viewed from the front of the outdoor unit 2 are indicated by arrows. In the first embodiment, a cross section of the separation surface 15 cut in a horizontal plane is curved in an arc. This configuration allows currents of air drawn in from the back surface 211 to be less obstructed by the partition plate 11 and the separation surface 15 on the back surface 211 side of the machine room 51. Consequently, more air can be passed through the heat exchanger 7 to improve the efficiency of heat exchange. Since the cross section of the separation surface 15 is bent in an arc, the area of the undersurface of the electric component box 10 is reduced. Therefore, a space is created between the electric component box 10 and the cooler 14 as compared with the case where the cross section of the separation surface is L-shaped. The separation surface 15 forms an arc similar to that of the partition plate 11. Consequently, more air can be passed between the plurality of fins 141.

A current of air striking the cooler 14 will be described. Air in the center of fan 8 rapidly flows straight from the back surface 211 toward the front surface 222. Air in portions away from the center of the fan 8 rapidly flows obliquely toward the bell mouth 202 in the front surface 222. Thus, a current of air easily flows between the separation surface 15 and the cooler 14, cooling the cooler 14. By the way, the cross section of a separation surface of an electric component box of a conventional outdoor unit which separates a housing chamber in which electronic components are housed from a blower room is L-shaped. Consequently, the separation surface of the conventional electric component box obstructs a current of air passing through obliquely, so that only part of the current of air strikes. Since the plurality of fins 141 is formed with the main surfaces facing the front surface 222, the direction of air flow paths formed between the plurality of fins 141 is nearly parallel to the direction of air flowing obliquely as described above. Consequently, air smoothly flows into the flow paths between the plurality of fins 141. This allows an increase in air passing through the flow paths between the plurality of fins 141.

Figure 7:
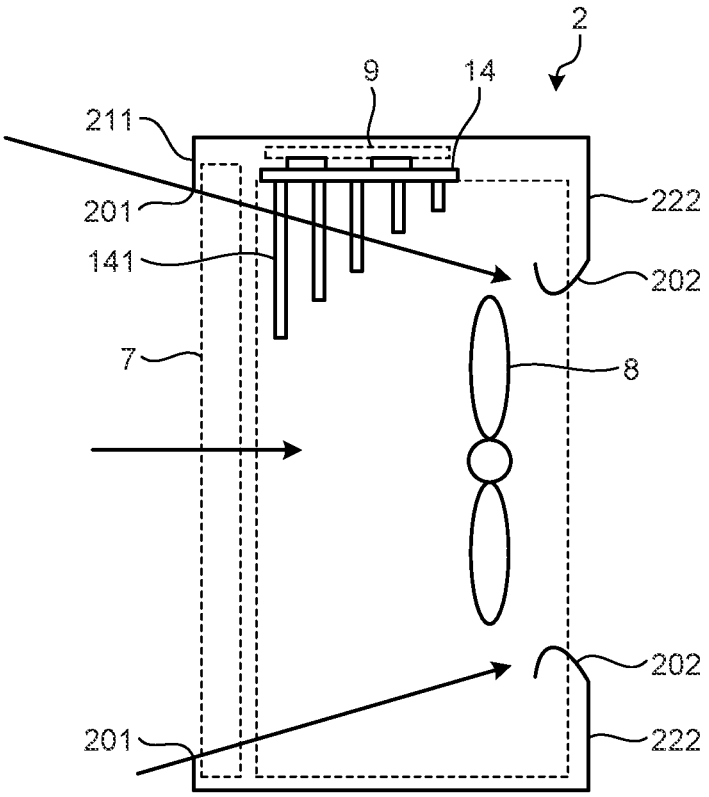
FIG. 7 is an opened-up view of the outdoor unit according to the first embodiment as viewed from the side.

FIG. 7 is an opened-up view of the outdoor unit 2 according to the first embodiment as viewed from the side. Currents of air traveling from the back surface 211 to the front surface 222 as viewed from the front of the outdoor unit 2 are indicated by arrows. Air flowing to the center of the fan 8 flows straight, while air flowing from an upper part and a lower part of the outdoor unit 2 flows toward the bell mouth 202 in the front surface 222. Although not indicated by arrows, air in a direction not described above, for example, air striking the front surface 222 once and bouncing back also flows in the outdoor unit 2. However, the velocity of the air bouncing back from the front surface 222 is slower than that of the air flowing to the center of the fan 8, and its flow rate is smaller, and thus its effect of cooling the cooler 14 is small. By the way, the respective heights of a plurality of fins of a cooler of a conventional air conditioner are the same. Thus, fins are also formed at a portion on the front surface side where the flow velocity is slow, and the material of the fins at the portion on the front surface side is wasted.

As described above, in the first embodiment, the cooler 14 has the plurality of fins 141. When the plurality of fins 141 is viewed from the front surface 222 of the outdoor unit 2, the main surfaces of the fins 141 with large areas face the front surface 222 side. The fins 141 on the back surface 211 side of the outdoor unit 2 are higher, and the fins 141 on the front surface 222 side are lower. Consequently, air flows efficiently through the fins 141. Therefore, the cooler 14 can be reduced in the size of the fins 141 as compared with conventional coolers. Further, the outdoor unit 2 can be reduced in weight and cost. Furthermore, since the separation surface 15 is shaped in an arc so that a space is formed between the separation surface 15 and the cooler 14, and the electronic components 17 are mounted at positions away from the cooler 14, a current of air easily strikes the fins 141 of the cooler 14. Moreover, the fins 141 that are struck by much air flowing through the outdoor unit 2 are made higher than the fins 141 that are not struck by much air. This allows an improvement in the efficiency of cooling the first power module 13 by the cooler 14. Consequently, there is no need to reduce the operating capacity of the air conditioner 100 to reduce the heat generation of the first power module 13. Further, the weight of the outdoor unit 2 can be reduced, and the cost of the outdoor unit 2 can be reduced. That is, it is possible to prevent an increase in the manufacturing cost of the outdoor unit 2. Furthermore, with the same weight and cost as those of conventional coolers, the cooler may be enhanced in cooling capacity compared to the conventional coolers. This can improve the operating capacity of the air conditioner 100 compared to that of conventional ones.

Furthermore, even if the shape of the fins 141 is the same as that of conventional ones, only by the separation surface 15 shaped in an arc so that a space is formed between the separation surface 15 and the cooler 14, the effect of being able to cool the fins 141 of the cooler 14 more than before can be provided. Furthermore, even if the shape of the separation surface 15 is the same as that of a conventional one, only by the fins 141 of the cooler 14 with the fins 141 on the back surface 211 side of the outdoor unit 2 being higher and the fins 141 on the front surface 222 side being lower, the effect of being able to make the cooler smaller, lighter, and lower in cost than before can be provided.

Second Embodiment

Figure 8:
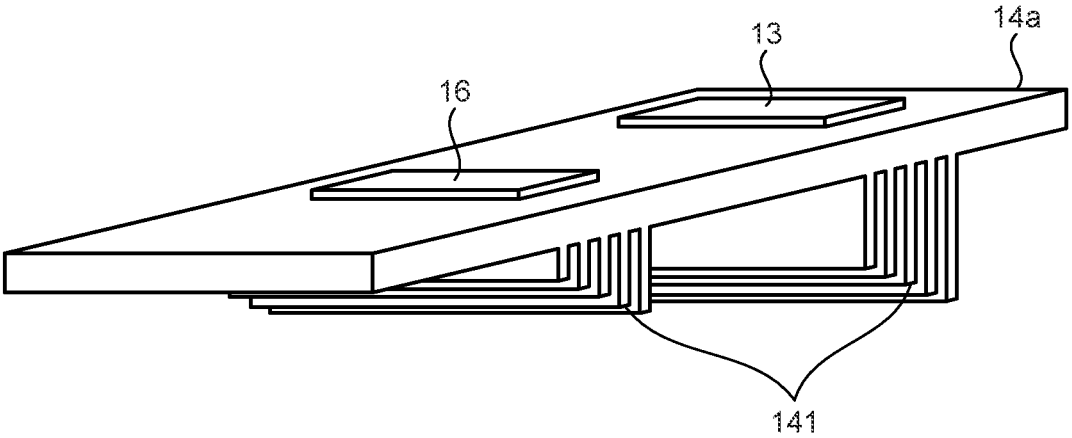
FIG. 8 is a first diagram illustrating the shape of a cooler according to a second embodiment.

FIG. 8 is a first diagram illustrating the shape of a cooler according to a second embodiment. A cooler 14*a* is provided in the outdoor unit 2 as in the first embodiment. In the present embodiment, the same reference numerals as those of the first embodiment are assigned to components having the same functions as those of the first embodiment to avoid redundant description. In the present embodiment, the cooler 14*a* is connected to a second power module 16. The second power module 16 is disposed on the same plane as the first power module 13. The second power module 16 has a smaller power loss than the first power module 13. Thus, the second power module 16 generates less heat than the first power module 13. The second power module 16 is disposed on the front surface 222 side of the center of the cooler 14*a* as viewed from the front of the outdoor unit 2. The first power module 13 is disposed on the back surface 211 side of the center of the cooler 14*a* as viewed from the front of the outdoor unit 2. The second power module 16 is included in the heat-generating component.

The cooler 14*a* has the fins 141 placed only directly below portions where the first power module 13 and the second power module 16 are mounted, and eliminates the fins 141 at portions where the first power module 13 and the second power module 16 are not mounted. Most of the heat generated by the first power module 13 and the second power module 16 is transferred to the fins 141 of the cooler 14*a* located directly below to be cooled. This prevents the generated heat from being transferred to the fins 141 far from the first power module 13 and the second power module 16. Therefore, even if the fins 141 are provided at portions far from the first power module 13 and the second power module 16, their effect of cooling them is small. The fins 141 of the cooler 14*a* are increased in height from the fin 141 closest to the front surface 222 toward the fin 141 closest to the back surface 211. The cooler 14*a*, which eliminates the fins 141 at the portions where the first power module 13 and the second power module 16 are not located, is manufactured with less aluminum material. Thus, the cooler 14*a* is reduced in weight and cost. Conventional coolers have many fins 141 placed in a portion where a power module is not disposed, and thus have a poor efficiency of cooling of the power module.

On the cooler 14*a*, the first power module 13 that generates more heat than the second power module 16 is disposed on the back surface 211 side of the outdoor unit 2 as described in the first embodiment, and the second power module 16 is disposed on the front surface 222 side. By thus disposing a power module that generates more heat in a position where it is cooled more easily, it can be prevented to mount a fan for cooling the power module that generates more heat, so that the size of the cooler 14*a* can be reduced.

As described above, in the present embodiment, the fins 141 are placed directly below the first power module 13 and the second power module 16 to eliminate the fins 141 at the portions where the first power module 13 and the second power module 16 are not located. This can prevent the cooler 14*a* from deteriorating in the function of cooling the first power module 13 and the second power module 16, and can prevent a decrease in the operating capacity of the air conditioner 100. Further, the cooler 14*a* is reduced in size, weight, and cost.

Figure 9:
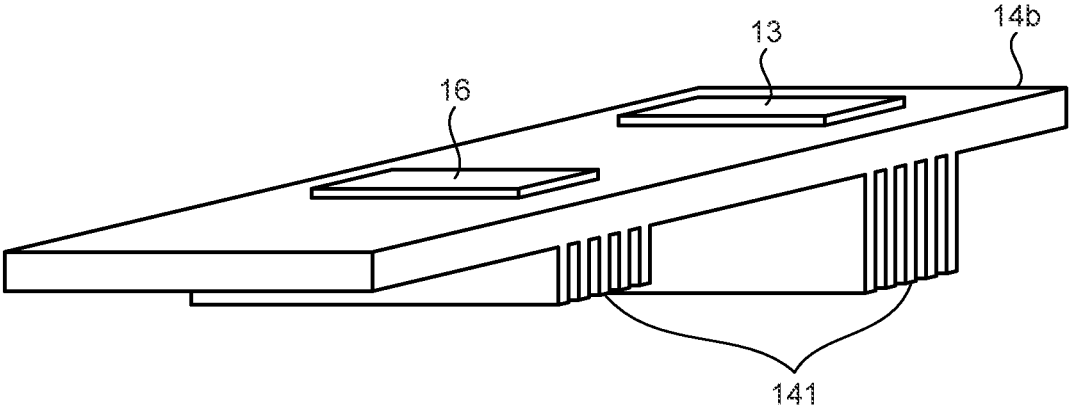
FIG. 9 is a second diagram illustrating the shape of a cooler according to the second embodiment.

FIG. 9 is a second diagram illustrating the shape of a cooler according to the second embodiment. Like the cooler 14*a*, a cooler 14*b* has the fins 141 placed only directly below the portions where the first power module 13 and the second power module 16 are mounted. However, the respective heights of the plurality of fins 141 placed directly below the first power module 13 are the same. Also, the respective heights of the plurality of fins 141 placed directly below the second power module 16 are the same. The plurality of fins 141 of the cooler 14*b* placed directly below the first power module 13 is higher than the plurality of fins 141 placed directly below the second power module 16. On the other hand, for the cooler 14*a*, the heights of the fins 141 are decreased from the first power module 13 toward the second power module 16.

Figure 10:
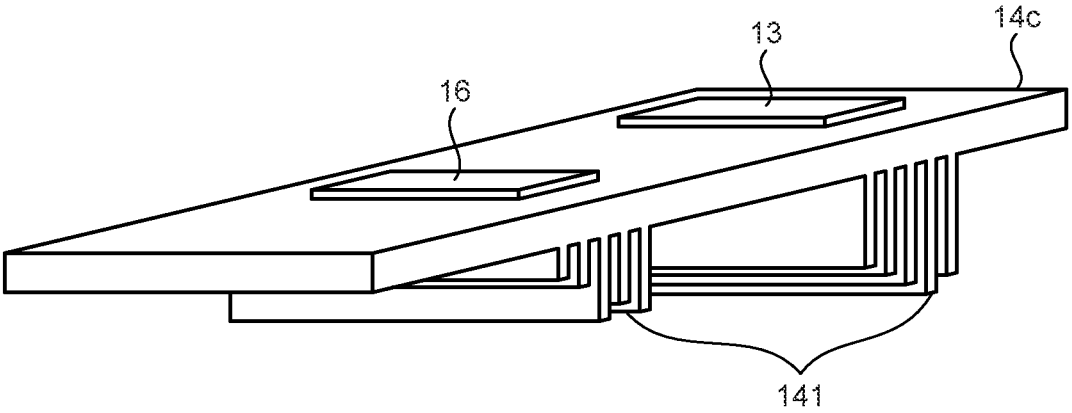
FIG. 10 is a third diagram illustrating the shape of a cooler according to the second embodiment.

FIG. 10 is a third diagram illustrating the shape of a cooler according to the second embodiment. Like the cooler 14*b*, a cooler 14*c* has the fins 141 placed only directly below the portions where the first power module 13 and the second power module 16 are mounted. However, the respective heights of the plurality of fins 141 placed directly below the first power module 13 are different. Also, the respective heights of the plurality of fins 141 of the cooler 14*c* placed directly below the second power module 16 are different. As viewed from the front of the outdoor unit 2, the average height of the fins 141 on the back surface 211 side of the center of the cooler 14*c* is higher than the average height of the fins 141 on the front surface 222 side of the center of the cooler 14*c*.

Figure 11:
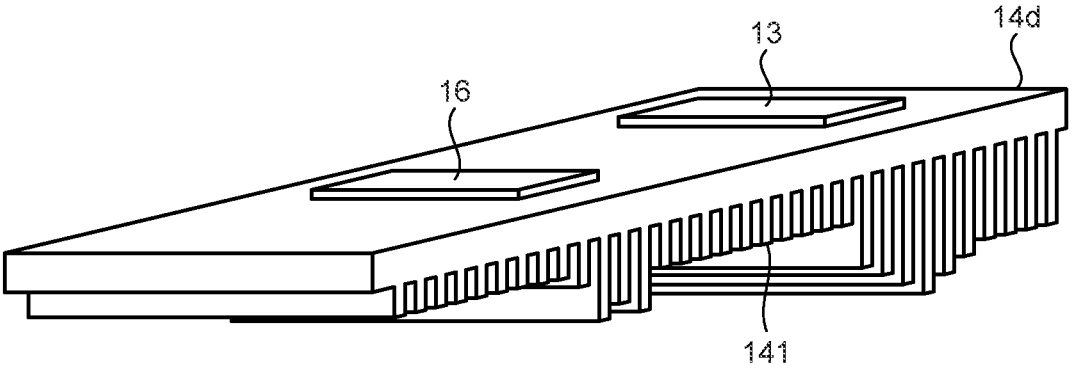
FIG. 11 is a fourth diagram illustrating the shape of a cooler according to the second embodiment.

FIG. 11 is a fourth diagram illustrating the shape of a cooler according to the second embodiment. A cooler 14*d* has the fins 141 on the back surface 211 side made higher and the fins 141 on the front surface 222 side lower as viewed from the front of the outdoor unit 2, and the fins 141 at the portions not directly below the first power module 13 and the second power module 16 formed by the fins 141 that are lower than any one of the fins 141 directly below the first power module 13 and the second power module 16.

Like the coolers 14*b* to 14*d*, even when the heights of the fins 141 are different from the heights of those of the cooler 14*a*, the same effect as that of the cooler 14*a* can be obtained.

The configurations described in the above embodiments illustrate an example of the subject matter of the present invention, and can be combined with another known art, and can be partly omitted or changed without departing from the scope of the present invention.

The invention claimed is:

1. An outdoor unit comprising:

a casing with an inlet formed in a back surface and an outlet formed in a front surface;

a fan accommodated in the casing to draw in air from the inlet and blow out the air from the outlet;

a compressor accommodated in the casing to compress a refrigerant;

a heat exchanger accommodated in the casing to cause heat exchange between the refrigerant and the air;

a partition plate partitioning an interior of the casing into a machine room in which the compressor is installed and a blower room in which the fan is installed;

a control board installed horizontally on a top of the partition plate across the machine room and the blower room;

an electric component box covering the control board;

a heat-generating component including a power module installed on the blower room side of the control board to drive the compressor and the fan;

a cooler connected to the heat-generating component and including a plurality of fins exposed from the electric component box; and an electronic component installed on the machine room side of the control board, wherein the electric component box includes a housing chamber housing the electronic component, the housing chamber is formed by surfaces including a separation surface being a vertical wall and facing the machine room side, and the separation surface has a curve-shape and is disposed between the electronic component and the blower room and between the electronic component and the back surface, and the curve-shape is curved so as to be closer to the back surface as the separation surface is closer to the side surface.

2. An air conditioner comprising:

the outdoor unit according to claim 1; and an indoor unit connected to the outdoor unit via refrigerant piping.

3. The outdoor unit according to claim 1, wherein each of the fins has a flat shape having a main surface and an opposite surface thereto;

the plurality of fins has the main surfaces facing the front surface, the plurality of fins includes fins on the back surface side of a center of the cooler as viewed from the front surface and fins on the front surface side of the center of the cooler as viewed from the front surface, a lowest fin of the fins on the back surface side is higher than a highest fin of the fins on the front surface side, and the electronic component is higher than the lowest fin.

4. The outdoor unit according to claim 1, wherein the plurality of fins has main surfaces facing the front surface, the plurality of fins includes fins on the back surface side of a center of the cooler as viewed from the front surface and fins on the front surface side of the center of the cooler as viewed from the front surface, a lowest fin of the fins on the back surface side is higher than a highest fin of the fins on the front surface side, and the electronic component is higher than the lowest fin of the plurality of fins.

5. The outdoor unit according to claim 4, wherein an average height of the fins on the back surface side of the center is higher than an average height of the fins on the front surface side of the center.

6. The outdoor unit according to claim 4, wherein the plurality of fins includes a fin closest to the front surface and a fin closest to the back surface, the plurality of fins is increased in height from the fin closest to the front surface toward the fin closest to the back surface.

7. The outdoor unit according to claim 4, wherein the heat-generating component includes a first power module and a second power module having a smaller power loss than the first power module, the cooler connects the first power module and the second power module, the plurality of fins is placed directly below the first power module and the second power module, the first power module is installed on the back surface side of the center, and the second power module is installed on the front surface side of the center.

8. The outdoor unit according to claim 7, wherein the fins at a portion not directly below the first power module and the second power module are shorter relative to the control board than any one of the fins installed directly below the first power module and the second power module.

* * * * *